US005164552A

United States Patent [19]

Pandeya et al.

[11] Patent Number: 5,164,552

[45] Date of Patent: Nov. 17, 1992

[54] COMPRESSOR SUCTION NOISE ATTENUATOR AND ASSEMBLY METHOD

[75] Inventors: Prakash N. Pandeya; Panteleimon V. Hatzikazakis, both of Bristol, Tenn.

[73] Assignee: Bristol Compressors, Bristol, Va.

[21] Appl. No.: 634,440

[22] Filed: Dec. 27, 1990

[51] Int. Cl.[5] ..... E21B 25/00; E21B 10/00

[52] U.S. Cl. ..... 181/249; 181/250; 181/403

[58] Field of Search ..... 181/240, 247, 248, 249, 181/250, 403

[56] References Cited

U.S. PATENT DOCUMENTS

| | | | |
|---|---|---|---|
| 3,645,358 | 2/1972 | Kubota et al. | 181/403 |
| 3,864,064 | 2/1975 | Gannaway | 181/403 |
| 4,401,418 | 8/1983 | Fritchman | 181/403 |

*Primary Examiner*—Russell E. Adams
*Assistant Examiner*—Khanh Dang

[57] ABSTRACT

A suction noise attenuator for in-line placement in one or more suction gas conduits of a gas compressor unit, and having an elongated, tubular body or shell having a base end and a closure end, a base cap on the base end and a closure cap on the closure end, said caps and body forming an elongated, substantially closed attenuation cell having major and minor transverse axes oriented normally to each other, an elongated wave modulating barrel formed on or affixed to the closure cap and having major and minor transverse axes oriented normally to each other, the barrel being positioned within the cell substantially longitudinally thereof with the major transverse axis of the barrel being angularly offset from the major transverse axis of the cell and substantially dividing the cell into enlongated substantially equal volume halves, a socket receiving the distal end of the barrel and being formed in the interior surface of the base cap and defined by a floor and a sealing wall surrounding the same and extending generally normally therefrom, a sealing surface on the distal end of the barrel engaging the sealing wall and forming a fluid seal therebetween, mating sealing shoulders on the closure end of the body and the closure cap and forming a fluid seal therebetween, one or more ports formed in the base cap and extending through the floor, one or more gas passages formed in the closure cap and barrel generally longitudinally thereof, the ports and passages being in fluid communication across the floor, and damping vents in the wall of the barrel placing the passages into fluid communication with each half of the cell.

16 Claims, 2 Drawing Sheets

COMPRESSOR SUCTION NOISE ATTENUATOR AND ASSEMBLY METHOD

This invention concerns novel construction and assembly procedure for attenuators or mufflers for reducing suction noise resulting from suction conduit vibration, valving operation, suction gas pulsing, or the like, of piston type compressors such as hermetically sealed units used in refrigerators, heat pumps, window units, or other such applications, and particularly concerns such attenuators for use with dual piston compressors employing dual suction valving and dual suction gas feed conduit means.

The use of noise attenuators which are mounted in-line in the suction conduit systems of hermetically sealed compressor units is of course well known as shown in U.S. Pat. Nos.: 3,101,891; 3,645,358; 3,864,064; and 4,239,461, the utility disclosures of which are incorporated herein by reference. As illustrated in these disclosures, all or part of the attenuator structures are made integrally with or permanently affixed to other components of the compressor such as the motor cap, shroud or the like. Such fixed position relationship of the attenuator part or parts with the compressor unit parts necessarily requires installation of the attenuator along with major components of the compressor. For such installation therefore, stringent assembly procedures and precise component manipulations are required if the desired gas sealing and structural stability of the attenuator in the compressor suction system is to be achieved.

Objects, therefore, of the present invention are: to greatly simplify the construction and assembly procedures for suction noise attenuators in compressors, particularly in small hermetically sealed, dual piston units, while providing markedly improved noise muffling; to provide such attenuators with design features which readily allow their manufacture from moldable plastic materials; and to provide improved structural design for the attenuators such that they can be plastic molded in parts and the parts frictionally assembled into a unit having exceptional strength, minimum weight, and fluid-tight joints.

These and other objects hereinafter appearing have been attained in accordance with the present invention through the discovery of suction noise attenuator construction providing excellent fluid sealing, physical strength, vibrational resistance, and noise muffling, the invention in its broad sense being defined as a suction noise attenuator for in-line placement in the suction gas conduit means of a gas compressor unit, comprising an elongated, tubular body means having a base end and a closure end, base cap means on said base end, closure cap means on said closure end, both of said cap means and said body means forming an elongated, substantially closed attenuation cell means having major and minor transverse axes oriented substantially normally to each other, elongated wave modulating barrel means projecting from the inner side of said closure cap means and having major and minor transverse axes oriented substantially normally to each other, said barrel means being positioned within said cell means substantially longitudinally thereof with the major transverse axis of said barrel means being angularly offset from the major transverse axis of said cell means and substantially dividing said cell means into elongated, substantially equal volume halves, socket means receiving a distal end portion of said barrel means and being formed in the interior surface of said base cap means and defined by floor means and sealing wall means surrounding the same and extending generally normally therefrom, sealing surface means on the distal end portion of said barrel means engaging said sealing wall means and forming a fluid seal therebetween, mating sealing shoulder means on said closure end of said body means and said closure cap means and forming a fluid seal therebetween, port means formed in said base cap means and extending through said floor means, gas passage means formed in said closure cap means and barrel means generally longitudinally thereof, said port means and passage means being in fluid communication across said floor means, and damping vent means in the wall of said barrel means placing said passage means into restrictive fluid communication with each half of said cell means.

In certain preferred embodiments:

(a) each of said passage means and port means is extended outwardly from its associated cap means by conduit segment means adapted for frictional, sliding connection into the suction gas conduit means of the compressor unit;

(b) said major transverse axes are oriented with respect to each other at an angle of from about 40 degrees to about 50 degrees;

(c) said sealing wall means is outwardly tapered to receive said sealing surface means which comprises the leading peripheral edge portion of the distal end of said barrel means, in a pressure sealing manner;

(d) said mating sealing surface means is provided with cooperating cam surface means for exerting a continuous sealing force on said closure cap means directed generally longitudinally of said body means inwardly of said cell means;

(e) the conduit segment means on said closure cap means is provided with sleeve means for receiving said suction gas conduit means of said compressor unit, said sleeve means being provided with sealing face means on its inner surface adapted to contact and seal against the insertion end means of said suction gas conduit means;

(f) the cam surface means on said closure cap means is located on semi-flexible peripheral wall means of said closure means extending inwardly of said cell means generally longitudinally of said body means;

(g) the sealing wall means of said socket means is slightly outwardly tapered at its entry portion and peripherally dimensioned with respect to the distal end portion of said barrel means such that forcing said end portion into said socket means will form a fluid seal between said end portion and said sealing wall means;

(h) the leading edge of either or both of the distal end portion of said barrel means and said sealing wall means is chamfered or curved to assist entry of said end portion into said socket means;

(i) said base cap means is integrally formed with said body means;

(j) the sealing face means of said sleeve means is tapered for receiving the insertion end means of said suction gas conduit means in a tight, frictional, sealing fit;

(k) the conduit segment means associated with said port means is provided with peripheral sealing ridge means adapted to provide a tight, frictional, sealing fit with the walls of suction conduit mounting wells provided in suction plenum means communicating with the compressor suction valving system;

(l) the attenuator is comprised of molded plastic material; and (m) a multiple compression chamber, gas compressor unit is provided with the attenuator of any one of the above described attenuator constructions mounted in-line in the suction conduit means or suction system of the unit.

In regard to the method aspect of the present invention, such is defined as the method for mounting the attenuator in-line into the suction conduit means of a compressor unit wherein motor cap means and mounting means therefor are provided on the outer end of the motor means, said cap means and mounting means are provided with cooperating friction locking means for locking said cap means to said mounting means as portions of said cap means are forced against portions of said mounting means, and wherein said suction conduit means of said compressor unit is affixed to said cap means, said method comprising friction fitting the conduit segment means of said passage means with said suction conduit means, poising said cap means over said mounting means in locking alignment while poising the insertion end of said conduit segment means of said port means over and in alignment with mounting well means in the compressor head, and forcing said cap means and said mounting means into engagement to effect the locking together thereof while simultaneously therewith forcing the insertion end of said conduit segment means into said mounting well means to effect a sealed connection thereto.

The invention will be understood further from the following description and drawing wherein.

Figure 1:
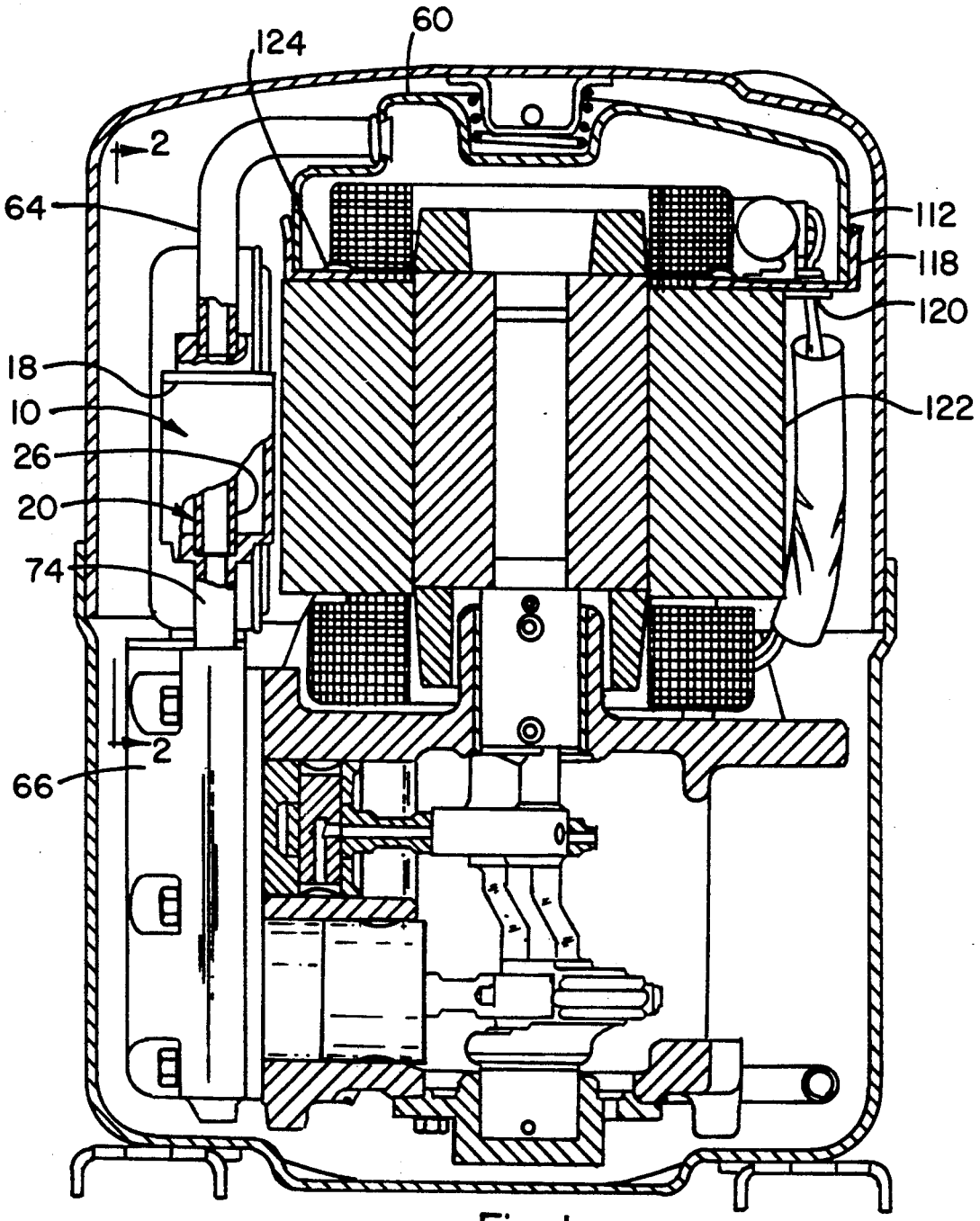
FIG. 1 is a cross-sectional view of a typical dual cylinder, hermetically sealed compressor provided with the present attenuator installed in the dual suction conduit system thereof.

Referring to the drawing, and with particular reference to the claims hereof, the attenuator comprises an elongated, tubular body means 10 having a base end 12 and a closure end 14, base cap means 16 on the base end, closure cap means 18 on the closure end, both of said cap means and said body means forming an elongated, substantially closed attenuation cell means generally designated 20 and having major and minor transverse axes, 22 and 24 respectively, oriented substantially normally to each other, elongated wave modulating barrel means 26 projecting from the inner side 27 said closure cap means and having major and minor transverse axes, 28 and 30 respectively, oriented substantially normally to each other, said barrel means being positioned within said cell means 20 substantially longitudinally thereof with the major axis 28 of said barrel means being angularly offset (a) from the major axis 22 of said cell means and substantially dividing said cell means into elongated, substantially equal volume halves 32 and 34, socket means 36 receiving the distal end portion 38 of said barrel means and being formed in the interior surface 40 of said base cap means and defined by floor means 42 and sealing wall means 44 surrounding the same and extending generally normally therefrom, sealing surface means 46 on the distal end portion 38 of said barrel means engaging said sealing wall means and forming a fluid seal therebetween, mating sealing shoulder means 48 and 50 respectively on said closure end of said body means and said closure cap means and forming a fluid seal therebetween, port means 52 formed in said base cap means and extending through said floor means, gas passage means 54, 55 formed in said closure cap means and barrel means generally longitudinally thereof, said port means and passage means being in fluid communication across said floor means, and damping vent means 56 in the wall 58 of said barrel means placing each said passage means into restrictive fluid communication with each half of said cell means.

As shown, the compressor motor cap or suction gas plenum 60 into which the dual suction tubes 62 and 64 are swedged, and the compressor head 66 or other suction gas inlet structure having suction channels 67, 69 formed therein, provide multiple suction gas conduit means into which the attenuator is affixed. For this purpose, conduit pair segments 68, 70 and 72, 74 are provided on closure cap means 18 and base cap means 16 respectively. Either or both of suction tubes 62 and 64 may be provided with a shoulder such as 76 to limit the insertion of the tubes into the conduit segments 68 and 70 to insure proper relative positioning of the attenuator in the suction conduit system. These tubes and conduit segments are dimensioned to provide substantially gas-tight frictional connection and for that purpose, a peripheral ring or ridge such as shown as 86 for segments 72, 74 may be provided on the tubes to assist in making a compressed, tight, sliding fit. It is noted that as shown in the drawing, the sleeves 78 and 80 of the conduit segments 62, 64 preferably are slightly tapered inwardly to provide sealing face means 63, 65 which tightly receive the larger diameter insertion end portions 82, 84 of the suction tubes. Periperal rings such as 86 provided on segments 72, 74 assist in frictional sealing in wells 88 and 90 respectively in the compressor head or contiguous intake structure.

An important feature of the particular embodiment of the present invention shown in the drawing resides in the configuration of the mating sealing shoulder means 48 and 50 of the body and closure cap, in combination with the configuration and dimensioning of the socket means 36 and barrel means 26 and its distal end portion 38. The unique construction and assembly procedure for the illustrated preferred embodiment of the present attenuator requires the substantially simultaneous formation of two permanent and important fluid-tight seals, i.e., the closure cap onto the body end, and the distal end portion of the barrel means into the base cap means.

To insure such sealing it is preferred that the length of barrel means 26 be such that it does not bottom out against the floor means 42 as the sealing surface 50 of the closure cap is forced tightly against sealing surface 48 on the body end. Such being the case, the sealing surface means 46 on the periphery of the distal end portion 38 of the barrel is dimensioned such that it can be forced into the socket means 36 and seal against the smaller periphery sealing wall means 44. In order to allow such forcing, a chamfer or curved surface 92 of suitable dimension is provided on the entry portion 93 of the sealing wall means to angularly contact the barrel end and direct it in a compressive manner into the socket means. Also, or in the alternative, the peripheral leading edge 94 of the barrel end may be chamfered or curved. It is noted that the sealing wall means 44 may be slightly tapered in the manner of 78 and 80 to further facilitate tight sealing.

Figures 2, 3, 4, 5:
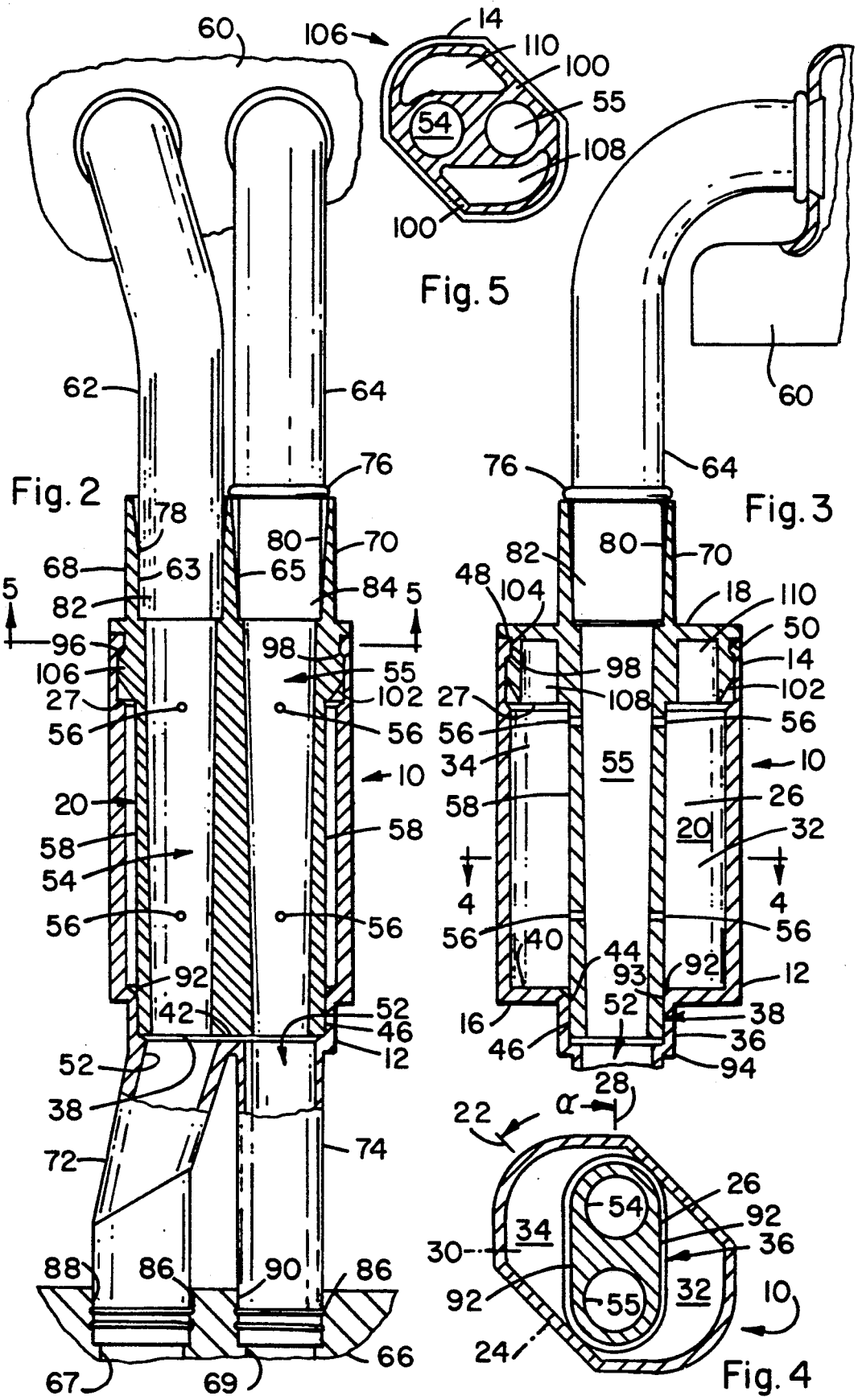
FIG. 2 is an enlarged longitudinal sectional view of the attenuator of FIG. 1 viewed in the direction of arrow 2, with contiguous other compressor unit portions shown.
FIG. 3 is a view as in FIG. 2 rotated clockwise 90 degrees.
FIG. 4 is a cross-sectional view taken along line 4—4 of FIG. 3 in the direction of the arrows.
FIG. 5 is a cross-sectional view of the structure of FIG. 2, taken along line 5—5 thereof in the direction of the arrows.

In concert with the formation of these seals, it is preferred that a mechanism be provided to both lock the closure cap means, barrel means and body means tightly together, and to assist in the actual formation and maintenance of the seals. This is accomplished by the provision of cooperating cam means 96, 98 on the closure cap and body end respectively, which cam means engage after the semi-flexible wall 100 is inserted into the body end with the aid of an angled periphery 102 which slides and is forced resiliently inwardly over lip 104 of the body end. The engagement of these cam surfaces 96, 98 generates a force vector directed generally longitudinally of the body which maintains a high degree of integrity in the closure cap/body seal, and in the barrel end/socket means seal. With reference to FIG. 5, the necessary flexibility and resiliency of wall 100 for providing the caming action of 96, 98 is achieved by forming the closure cap body portion 106 with large cavities 108, 110 which gives a proper wall thickness of wall 100 to impart the necessary resiliency thereto.

The angular orientation of the major axes 22 and 28 of the cell and barrel respectively, especially the approximate 40 degree–50 degree angle shown, wherein cell halves 32 and 34 are at least substantially isolated, has been found to maximize the noise attenuation while minimizing the thickness of the attenuator body, which combination is especially important in small, sealed compressor units wherein space is at a premium.

A particularly significant structural feature is the constant intercommunication of each of the conduit passages 54, 55 with each half of the cell by way of damping vents 56. It appears that enhancement of the noise reduction achieved by the present attenuator results at least partially from use of the directionally opposite or non-resonant wave formation effected by operation of the multiple suction chambers and valving of the compressor. Wave dislocation rather than reinforcement appears to result from the use and location of damping vents 56. In this regard, the vent size and number can be widely varied to maximize the muffling for a particular compressor capacity and design.

For the particular embodiment shown in the drawings, a typical set of vents of 0.050 inch diameter located adjacent the top and bottom of barrel 26 in equal numbers is eight, and a typical total volume of the cell halves is about 1.3 in.$^3$.

Typically, the vent size, number and location are determined by a combination of factors including the attenuator cell volume, suction gas velocity through the attenuator conduits and passages, the frequency bands to be attenuated, and suction gas temperature, or the like.

In the embodiment shown in the drawings, the ratio of the length of barrel 26 to the total cross-sectional flow area of passages 54 and 55 is from about 6.5 to about 9.5, and the ratio of said total flow area to the total volume of both cell halves 32 and 34 is from about 0.2 to about 0.5. The materials of construction may be plastic, ceramic or other; however, moldable plastic such as temperature and oil resistant polyamide such as nylon, polycarbonate, polyester, polyimide, polyurethane or the like may be used.

Figure 6:
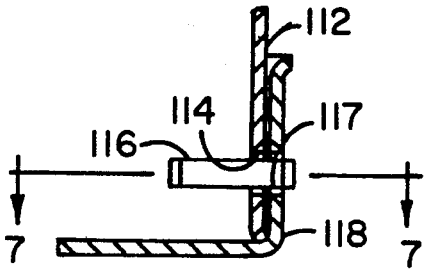
FIG. 6 is a cross-sectional view of the flanges of the motor cap and its mount showing a useful snap connection.
Figure 7:
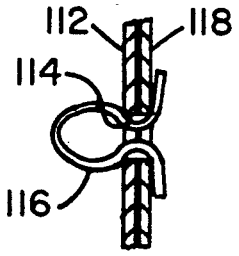
FIG. 7 is a cross-sectional view taken along line 7—7 of FIG. 6 in the direction of the arrows.

Referring to FIGS. 6 and 7, the metal motor cap 60 is provided with a flange 112, which in the embodiment shown is provided with a series of rectangular, oblong, round, or other configuration struck out apertures 114, e.g., four to eight of a dimension e.g., of about one quarter inch diameter circular holes, suitably peripherally spaced therearound and receiving peripherally spaced locking clips 116 inserted through similar apertures 117 in the upturned flange 118 of the motor cap mounting means, the base 120 of which is secured to the top of the motor stator 122, e.g., by the stator assembly bolts or rivets 124. Many types of such snap-on fastening devices are known and useful in the present invention. After assembly of the cap, mounting means, attenuator and compressor head, more permanent means such as screws may be employed to secure the motor cap to its mounting means should it be desired.

In assembling the present attenuator into a compressor unit, the cap 18 is frictionally, sealing forced into the body closure end to complete the attenuator assembly. The suction tubes 62, 64 which are already affixed to the motor cap or suction plenum 60 are forced into sleeves 78, 80 of the attenuator and the cap 60 with attenuator attached then placed in position on the motor end by forcing conduit segments 72, 74 into their wells 88, 90 in the cylinder head 66. This simple assembly procedure can be carried out very rapidly and accurately and effects enhanced structural stability and sealing of the parts.

The invention has been described in detail with particular reference to preferred embodiments thereof, but it will be understood that variations and modification will be effected within the spirit and scope of the invention.

We claim:

1. A suction noise attenuator for in-line placement in a suction gas conduit means of a gas compressor unit, comprising an elongated, tubular body means having a base end and a closure end, base cap means on said base end, closure cap means on said closure end, both of said cap means and said body means forming an elongated, substantially closed attenuation cell means having major and minor transverse axes oriented substantially normal to each other, elongated wave modulating barrel means having wall means terminating in a distal end portion and projecting from an inner side of said closure cap means, said barrel means having major and minor transverse axes oriented substantially normal to each other, said barrel means being positioned within said cell means substantially longitudinally thereof with the major transverse axis of said barrel means being angularly offset from the major transverse axis of said cell means and substantially dividing said cell means into enlongated, substantially equal volume halves, socket means receiving said distal end portion of said barrel means and being formed in an interior surface of said base cap means and defined by floor means and sealing wall means surrounding said floor means and extending inwardly and generally normal therefrom, sealing surface means on the distal end portion of said barrel means engaging said sealing wall means and forming a fluid seal therebetween, mating sealing shoulder means on said closure end of said body means and said closure cap means and forming a fluid seal therebetween, port means formed in said base cap means and extending through said floor means, gas passage means formed in said closure cap means and barrel means generally longitudinally thereof, said port means and passage means being in fluid communication across said floor means, and damping vent means in said wall means of said barrel means placing said passage means into fluid communication with each half of said cell means.

2. The attenuator of claim 1 wherein said base cap means is provided with conduit segment means extending outwardly therefrom in a direction generally axially of said tubular body means, and each of said passage means and port means is extended outwardly through said conduit segment means, said conduit segment means being adapted for frictional, sliding connection into the suction gas conduit means of the compressor unit.

3. The attenuator of claim 1 wherein (said major transverse axes) of said cell means and barrel means are oriented with respect to each other at an angle of from about 40 degrees to about 50 degrees.

4. The attenuator of claim 1 wherein said sealing wall means is outwardly tapered to receive said sealing surface means which comprises (a leading peripheral edge portion) of the distal end of said barrel means, in a pressure sealing manner.

5. The attenuator of claim 1 wherein said mating sealing shoulder means is provided with cooperating cam surface means for exerting a continuous sealing force on said closure cap means directed generally longitudinally of said body means toward said cell means.

6. The attenuator of claim 2 wherein said conduit segment means on said closure cap means is provided with sleeve means for receiving said suction gas conduit means of said compressor unit, said suction gas conduit means having an insertion end portion, said sleeve means being provided with sealing face means on its inner surface means adapted to contact and seal against said insertion end portion of said suction gas conduit means.

7. The attenuator of claim 5 wherein the sealing shoulder means of said closure cap means is semi-flexible and extends inwardly of said cell means generally longitudinally of said body means, and said cam surface means is located thereon.

8. The attenuator of claim 1 wherein the sealing wall means of said socket means has an entry portion which is slightly outwardly tapered and peripherally dimensioned with respect to the distal end portion of said barrel means such that forcing said end portion into said socket means through said entry portion will form a fluid seal between said distal end portion and said sealing wall means.

9. The attenuator of claim 1 wherein at least one of said distal end portion of said barrel means or said sealing wall means is chamfered or curved to assist entry of said end portion into said socket means.

10. The attenuator of claim 1 wherein said base cap means is integrally formed with said body means.

11. The attenuator of claim 6 wherein the sealing face means of said sleeve means is tapered for receiving said insertion end portion of said suction gas conduit means in a tight, frictional, sealing fit.

12. The attenuator of claim 2 wherein said conduit segment means of said base cap means is provided with peripheral sealing ridge means adapted to provide a tight, fricitional, sealing fit with walls of suction conduit mounting wells provided in a compressor head and communicating with a compressor suction valving system.

13. The attenuator of claim 1 comprised of molded plastic material.

14. A refrigerant compressor having cylinder means, piston means mounted for reciporcation therein, cylinder head means mounted over the end of said cylinder means, and refrigerant discharge valve means intermediate said cylinder means and said cylinder head means to provide compression chamber means and discharge passage means, and adapted to open said discharge passage means for allowing pressurized refrigerant on the compression stroke of said piston means to allow flow from said compression chamber means into said cylinder head means and to close said discharge passage means on the suction stroke of said piston means, suction conduit means adapted to interconnect suction channel means with suction plenum means, said channel means adapted to communicate with said compression chamber means, suction valve means in said channel means and adapted to open said channel means for allowing suction gas to flow into said compression chamber means on the suction stroke of said piston means and to close said channel means on the compression stroke of said piston means, suction noise attenuator means in said suction conduit means comprising an elongated, tubular body means having a base end and a closure end, base cap means on said base end, closure cap means on said closure end, both of said cap means and said body means forming an elongated, substantially closed attenuation cell means having major and minor transverse axes oriented substantially normal to each other, elongated wave modulating barrel means having wall means terminating in a distal end portion and projecting from an inner side of said closure cap means, said barrel means having major and minor transverse axes oriented substantially normal to each other, said barrel means being positioned within said cell means substantially longitudinally thereof with the major transverse axis of said barrel means being angularly offset from the major transverse axis of said cell means and substantially dividing said cell means into enlongated, substantially equal volume halves, socket means receiving said distal end portion of said barrel means and being formed in an interior surface of said base cap means and defined by floor means and sealing wall means surrounding said floor means and extending generally normal therefrom, sealing surface means on the distal end portion of said barrel means engaging said sealing wall means and forming a fluid seal therebetween, mating sealing shoulder means on said closure end of said body means and said closure cap means and forming a fluid seal therebetween, port means formed in said base cap means and extending through said floor means, gas passage means formed in said closure cap means and barrel means generally longitudinally thereof, said port means and passage means being in fluid communication across said floor, and damping vent means in said wall means of said barrel means placing said passage means into fluid communication with each half of said cell means.

15. The attenuator of claim 1 wherein the said suction gas conduit means of said compressor unit, said port means in said base cap means, and said passage means in said barrel means are dual.

16. The attenuator of claim 14 wherein the said suction gas conduit means of said compressor unit, said port means in said base cap means, and said passage means in said barrel means are dual.

* * * * *